United States Patent [19]

Gravatt

[11] Patent Number: 4,972,531

[45] Date of Patent: Nov. 27, 1990

[54] JET NOZZLE ASSEMBLY FOR BATH TUBS

[76] Inventor: Eugene M. Gravatt, 26849 Cuatro Milpas St., Valencia, Calif. 91355

[21] Appl. No.: 379,432

[22] Filed: Jul. 13, 1989

[51] Int. Cl.[5] ..... A61H 33/02

[52] U.S. Cl. ..... 4/542; 239/600

[58] Field of Search ..... 4/492, 541, 542, 543, 4/544, 559, 567, 568, 570; 128/66; 239/416.5, 425.5, 428.5, 600

[56] References Cited

U.S. PATENT DOCUMENTS

| | | | |
|---|---|---|---|
| 3,336,921 | 8/1967 | Lloyd | 128/66 |
| 3,905,358 | 9/1975 | Jacuzzi | 128/66 |
| 3,986,217 | 10/1976 | Doerr et al. | 4/542 |
| 4,264,039 | 4/1981 | Moreland | 239/428.5 |
| 4,320,541 | 3/1982 | Neenan | 4/492 |
| 4,335,854 | 6/1982 | Reynoso | 239/428.5 |
| 4,349,923 | 9/1982 | Chalberg | 4/542 |
| 4,520,514 | 6/1985 | Johnson | 4/541 X |
| 4,586,204 | 5/1986 | Daniels | 4/542 |
| 4,593,420 | 6/1986 | Tobias et al. | 4/542 X |
| 4,692,950 | 9/1987 | Henkin et al. | 4/542 |
| 4,717,078 | 1/1988 | Arp | 4/492 X |

FOREIGN PATENT DOCUMENTS

| | | | |
|---|---|---|---|
| 119581 | 9/1984 | European Pat. Off. | 4/542 |
| 234723 | 9/1987 | European Pat. Off. | 4/542 |
| 2183505 | 6/1987 | United Kingdom | 239/428.5 |

*Primary Examiner*—Ernest G. Cusick
*Assistant Examiner*—Robert M. Fetsuga
*Attorney, Agent, or Firm*—Poms, Smith, Lande & Rose

[57] ABSTRACT

An adjustable jet nozzle assembly for directing the flow of fluid through the nozzle. The assembly comprises a jet body on the exterior of the tub mounted in an aperture in the wall of the tube with a wall fitting on the interior of the tub threadably engaging the jet body. An apertured eyeball jet portion is pre-mounted in a face plate threadably engaging the wall fitting providing a smooth continuous flush appearance when installed. The eyeball jet portion is self-lubricating thereby requiring little maintenance while providing smooth operation.

4 Claims, 2 Drawing Sheets

Fig. 4.
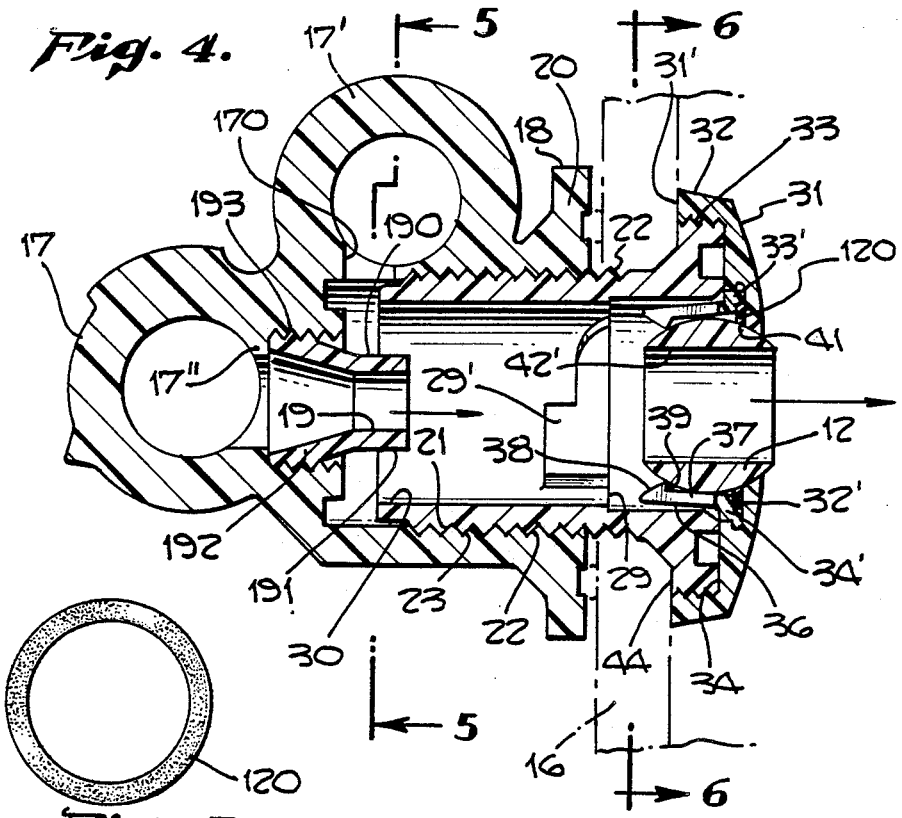
Fig. 7.
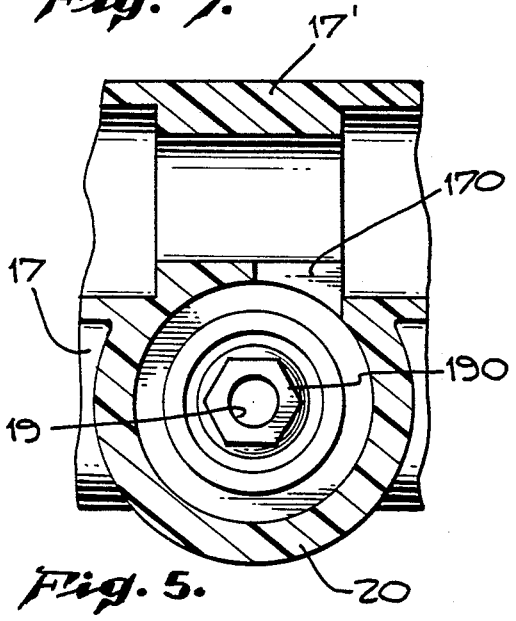
Fig. 5.
Fig. 6.
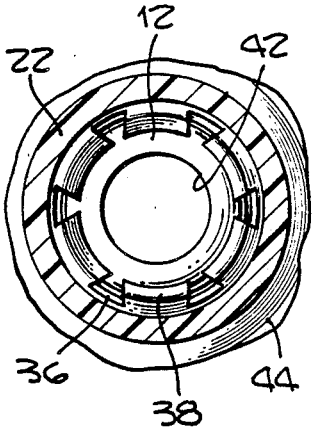

JET NOZZLE ASSEMBLY FOR BATH TUBS

BACKGROUND OF THE INVENTION

1. Field of the Invention

The invention relates to bath tubs or the like; and, more particularly, to a jet nozzle assembly for directing a fluid flow into the interior of the bath tub.

2. Description of the Prior Art

Bath tubs and therapy pools or the like are well known in the prior art and extremely popular. Some such bath tubs and therapy pools are disclosed in U.S. Pat. Nos. 3,540,438; 3,605,131; 3,628,529; 3,662,406; 3,788,306; 3,890,656; 3,905,358; 3,985,303 and 3,986,217. These prior art devices all have some type of adjustable nozzle assembly for adjusting fluid flow. This is desirable in such tubs so as the user can be able to direct the fluid flow on any body part desired.

In U.S. Pat. No. 4,349,923 to Chalberg, an improved adjustable jet nozzle assembly is disclosed and the advantage thereof of such nozzle assembly over the aforementioned prior art nozzle assemblies are discussed. Specifically, the Chalberg nozzle assembly is disclosed as providing a nozzle assembly which extends only slightly beyond the interior wall surface of the tub in which it is installed and which provides a relatively flat minimum protrusion devoid of sharp surfaces, corners and the like which might injure the user. The Chalberg assembly also eliminates the need for mounting screws or the like and provides an externally visible structure of smooth and continuous design which enhances the overall look.

However, in Chalberg, the eyeball jet portion 16 of the jet nozzle assembly is a separate part from the remaining components of the jet nozzle assembly. Thus, eyeball jet portion 16 of Chalberg is loose with respect to face cap 18. When the parts of Chalberg's nozzle is shipped to the installer, the parts 16, 18 are loose. There is a need for a jet nozzle assembly wherein the eyeball jet portion is pre-assembled to the face cap for proper alignment and ease of assembly. Such assembled parts should be self-lubricating to provide long life and smooth operation in use.

SUMMARY OF THE INVENTION

It is an object of this invention to provide an improved adjustable jet nozzle assembly for a bath tub or the like.

It is a further object of this assembly to provide an adjustable jet nozzle assembly for a bath tub or the like which is secured to a jet body through an aperture in the wall of the tub and provides means for controlling the direction of the nozzle.

It is still further an object of this invention to carry out the foregoing object wherein the eyeball jet nozzle portion of the jet nozzle assembly is pre-assembled to the face plate prior to installation for ease of assembly and proper alignment.

It is yet another object of this invention to provide a jet nozzle assembly having an eyeball jet nozzle portion which is self-lubricating within the face plate in which it is mounted.

These and other objects are preferably accomplished by providing an adjustable jet nozzle assembly having a jet body on the exterior of a bath tub mounted in an aperture in the wall of the tub with a wall fitting on the interior of the tub threadably engaging the jet body. An apertured eyeball jet portion is pre-mounted in a face plate threadably engaging the wall fitting providing a smooth continuous flush appearance when installed. The eyeball jet portion is self-lubricating thereby requiring little maintenance while providing smooth operation.

BRIEF DESCRIPTION OF THE DRAWING

FIG. 4 is a view taken along lines 4—4 of FIG. 3;

FIG. 5 and 6 are views taken along lines 5—5 and 6—6, respectively, of FIG. 4; and FIG. 7 is a plan view of a washer that may be used in the assembly of FIG. 4.

DESCRIPTION OF THE PREFERRED EMBODIMENT

Figure 1:
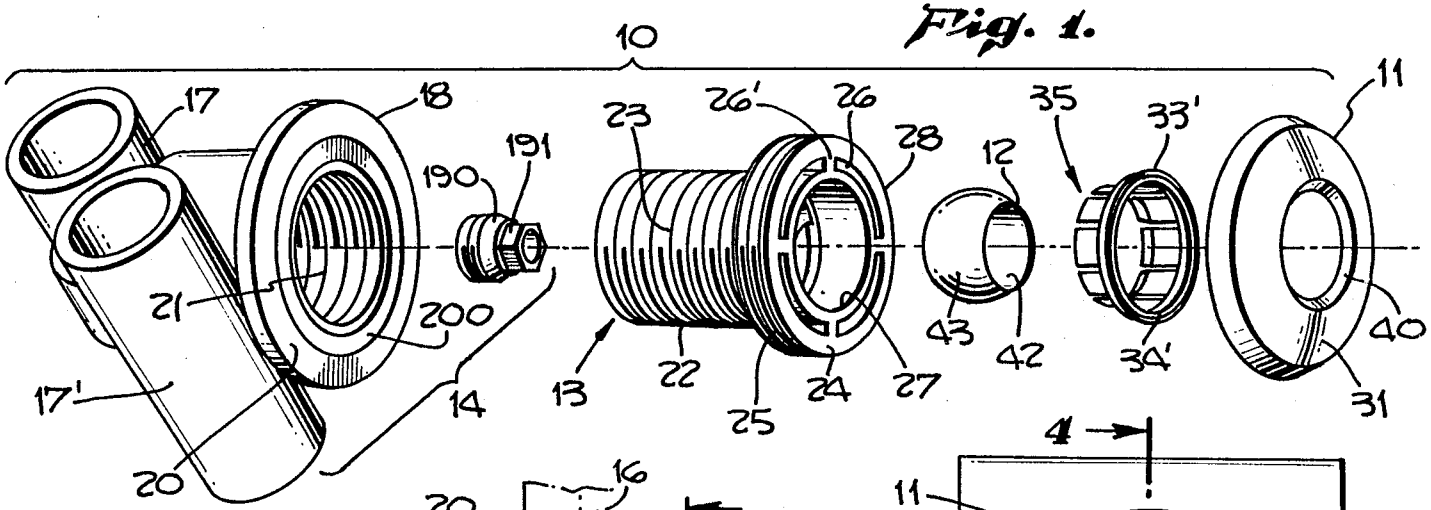
FIG. 1 is an exploded view of the jet nozzle assembly of the present invention.
Figure 3:
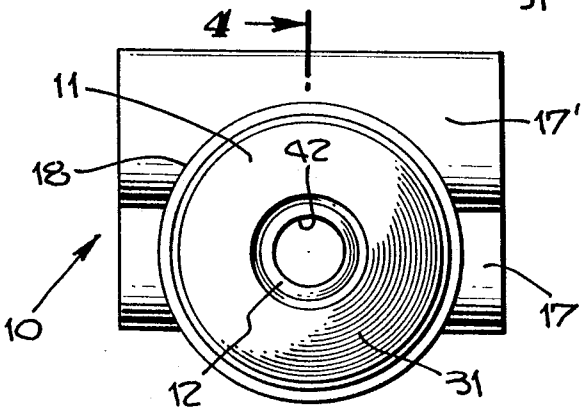
FIG. 3 is a view taken along lines 3—3 of FIG. 2.

Referring now to FIG. 1 of the drawing, an adjustable jet nozzle assembly 10 is shown comprising a face cap 11, an eyeball jet portion 12, an insert 33', a wall fitting 13 and a jet body 14. Assembly 10 is adapted to be mounted in an aperture 15 (FIG. 2) in the wall 16 of a bath tub or the like. Jet body 14 has a throughpipe 17 (FIG. 1) with an outlet 18. A second throughpipe 17' may also be provided extending parallel to throughpipe 17 having an inlet 170 (FIG. 4) communicating with the interior of fitting 13. A threaded fitting 190 having a hex nut 191 with a restricted throughbore 19 leading from a tapered body portion 192 having threads 193 on the exterior thereof is threadably mounted internally of outlet 18 into threaded midportion 17'' of throughpipe 17 fluidly communicating at one end with the interior of throughpipe 17 and having its longitudinal axis coincident with the longitudinal axis of outlet 18 to provide restricted fluid flow thus forming a high flow rate jet of water and air out of outlet 18 as is well known in the art. Outlet 18 has a peripheral flange 20 which abuts against the exterior of wall 16, as seem in FIG. 2, and is threaded on the interior 21 thereof. An annular recess 200 is provided in the face of flange 20 for reasons to be discussed.

Wall fitting 13 (FIG. 1) has an elongated cylindrical portion 22 threaded on the exterior 23 thereof. Wall fitting 13 also has a cylindrical portion 24, greater in outer diameter than the outer diameter of portion 22 and integral therewith, also threaded on the exterior 25. An annular groove 26, separated into arcuate sections by spaced flanges 26', is provided in cylindrical portion 24. As seen in FIG. 1, groove 26 is formed between inner wall 27 and outer wall 28. A stop shoulder 29 (see FIG. 4) is provided on the interior 30 of cylindrical portion 22 comprised of spaced L-shaped arcuate sections 29'.

Face cap 11 has an outer flange 31 (FIG. 1) with a smooth concave outer surface and an inwardly extending peripheral flange 32 (FIG. 4). Flange 32 is threaded on its interior 33 and has a flat undersurface 34. As seen in FIG. 4, a round cavity 32' is provided on the underside of face cap 11. An insert 33' (FIG. 1) is snap fit into cavity 32' having a round ring portion 34' snap fitting into cavity 32' and an integral inwardly extending cylindrical split wall portion 35 having spaced downwardly extending slightly curved outer wall portions 36 (see also FIG. 6) and a downwardly extending inner wall 37 spaced from wall 36. At the bottom of wall portions 36, the wall portions 36 curve inwardly to form tabs 38. Tabs 38 extend inwardly toward the central axis of wall portion 35 beyond inner wall 37 forming lips 39. A tapered wall 40 (FIG. 1) extends from concave wall 31 downwardly and inwardly toward the central axis of face cap 11 forming an inwardly extending lip 41 (FIG. 4).

As particularly contemplated in the present invention, jet eyeball nozzle portion 12 is pre-mounted in face cap 11 by snap fitting the same into insert 33' between wall portions 35 and is retained therein. If desired, a teflon washer 120 (FIGS. 4 and 7) may be provided between ring portion 34' and cavity 41. Jet eyeball nozzle portion 12 is substantially spherical in shape having a throughbore 42 and an outer concave surface 43. Insert 33' thus acts as a cage portion for nozzle portion 12.

Figure 2:
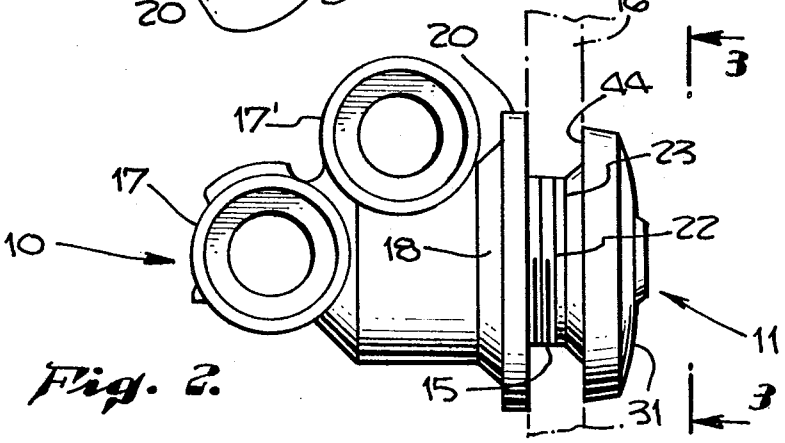
FIG. 2 is a fully assembled side view of the nozzle of the invention.

In assembling the parts of FIG. 1, as seen in FIG. 2, jet body 14 is mounted on the outside of wall 16 with flange 20 abutting thereagainst. Prior to such mounting, a suitable glue, such as a silicone sealant, is provided on flange 20. Thus, at assembly to wall 16, some of the sealant remains in recess 200 and provides a good seal. Threaded portion 22 of wall fitting 13 is threaded into outlet 18 of jet body 14, with threaded surface 23 threadably engaging inner threaded portion 21, with the underside 44 (FIG. 4) of cylindrical portion 24 abutting against the inside of wall 16. Face cap 11, with insert 33' snap fit therein and eyeball portion 12 snap fit into insert 33', is now threadably engaged to wall fitting 13. Threads 33 threadably engage threads 25 and cap 11 is tightened until the inside wall 31' of flange 31 abuts against the side of wall 16 as seen in FIGS. 2 and 4.

Eyeball portion 12 thus snaps into face cap 11 and is retained therein between lips 39, 41 as seen in FIG. 4. Although face cap 11 and eyeball portion 12 may be made of any suitable materials, such as various plastics, (for example, ABS plastic) stainless steel, etc., as particularly contemplated in the present invention, insert 33' is preferably made of a plastic material, such as Teflon, or Delrin, manufactured by Du Pont, having a low coefficient of friction and memory retention so that eyeball portion 12 not only rotates within face cap 11 (thus orienting the outlet 42 and the direction of the jet of fluid) but is self-lubricating. Such materials also allow eyeball portion 12 to be snapped into and out of cap 11 due to the inherent resiliency of the material. The preassembled parts 11, 12 allow these parts to be shipped to a customer as one preassembled unit and not a number of loose pieces. No springs or screws or the like are needed.

There is thus disclosed an improved adjustable jet nozzle assembly for use in hot baths or the like. The assembly 10 disclosed herein can be adapted to any preexisting bath tub apparatus insofar as the face cap 11, eyeball portion 12 and wall fitting 13 can be threaded into any preexisting jet body (using suitable thread reducers, if necessary). Eyeball portion 12 can be quickly and easily snapped out of the face cap 11 if there is a failure of the eyeball portion 12. The entire assembly 10 can be assembled and secured to the bath tub wall 16 without any tools and provides an attractive appearance. It is inexpensive to manufacture, ship and install.

I claim:

1. A nozzle assembly for connection to an internally threaded jet body mounted adjacent an aperture through the wall of a bath tub for diverting the flow of fluid from a source of fluid entering said jet body comprising:

a wall fitting having a throughbore adapted to threadably engage said jet body, said wall fitting having an externally threaded portion receivable within said internally threaded jet body and an integral externally threaded flange adapted to abut against the inside wall of said bath tub when assembled to said jet body;

a face cap having a central aperture there through and an undersurface from which depends an internally threaded flange portion for threadably engaging the externally threaded portion of said wall fitting, said face cap also having a round cavity on the undersurface thereof surrounding said central aperture and an integral apertured cage portion surrounding said central aperture, said cage portion having a ring portion snap fitting into said round cavity, said cage portion also having an integral generally cylindrical portion extending from said ring portion and separated into spaced split wall resilient portions, said split wall portions having inwardly extending protrusions at the terminal ends thereof, said protrusions extending inwardly toward the central longitudinal axis of said cage portion, and an apertured generally spherical eyeball jet portion snap fitting into said cage portion and retained therein by engagement at one end bearing against said protrusions and at the other end by bearing against lip surrounding said central aperture of said face cap and freely mounted in said cage portion and rotatable therein, said cage portion and said jet portion thereby providing a preassembled part of said assembly with said jet portion trapped in said cage portion and retained therein by engagement with said protrusions and said lip.

2. In the assembly of claim 1 wherein said face cap and said eyeball jet portion is comprised of plastic.

3. In the assembly of claim 2 wherein said cage portion is of a self-lubricating material having a low coefficient of friction and memory retention.

4. In the assembly of claim 3 wherein said self-lubricating material is Delrin material.

* * * * *